United States Patent [19]

Hewitt

[11] 4,330,610

[45] May 18, 1982

[54] METHOD OF IMAGING OVERCOATED PHOTORECEPTOR CONTAINING GOLD INJECTING LAYER

[75] Inventor: Harvey J. Hewitt, Williamson, N.Y.

[73] Assignee: Xerox Corporation, Stamford, Conn.

[21] Appl. No.: 270,421

[22] Filed: Jun. 4, 1981

Related U.S. Application Data

[62] Division of Ser. No. 127,174, Mar. 5, 1980, Pat. No. 4,297,424.

[51] Int. Cl.[3] ..... G03G 13/22; G03G 13/16

[52] U.S. Cl. ..... 430/126; 430/31

[58] Field of Search ..... 430/31, 57, 58, 60, 430/63, 66, 67, 126

[56] References Cited

U.S. PATENT DOCUMENTS

| | | | |
|---|---|---|---|
| 3,312,548 | 4/1967 | Straughan | 430/57 |
| 3,355,289 | 11/1967 | Hall et al. | 430/57 |
| 3,635,705 | 1/1972 | Ciuffini | 430/57 |
| 3,655,377 | 4/1972 | Sechak | 430/57 |
| 3,861,913 | 2/1975 | Chiou | 430/58 |
| 3,867,143 | 2/1975 | Tanaka et al. | 430/67 |
| 3,879,199 | 4/1975 | Trubisky | 430/57 |
| 4,015,985 | 4/1977 | Jones | 430/63 |
| 4,123,269 | 10/1978 | Von Hoene et al. | 430/67 |
| 4,251,612 | 2/1981 | Chu et al. | 430/67 X |
| 4,254,199 | 3/1981 | Tutihasi | 430/67 X |
| 4,275,132 | 6/1981 | Chu et al. | 430/31 |
| 4,286,033 | 8/1981 | Neyhart et al. | 430/67 X |
| 4,287,279 | 9/1981 | Brown et al. | 430/67 X |

FOREIGN PATENT DOCUMENTS

| | | | |
|---|---|---|---|
| 7604387 | 4/1976 | Netherlands | 430/57 |

*Primary Examiner*—Roland E. Martin, Jr.
*Attorney, Agent, or Firm*—E. O. Palazzo

[57] ABSTRACT

This invention is directed generally to a layered inorganic photoresponsive device, this device being comprised of a substrate, or supporting base, containing on its surface a layer of hole injecting material comprised of gold, a hole transport layer in operative contact with the hole injecting layer, the transport layer being comprised of a halogen doped selenium arsenic alloy, wherein the percentage of selenium present is from about 99.5 percent to about 99.9 percent, the percentage of arsenic present is from about 0.5 percent to 0.1 percent, the percentage of halogen present ranges from about 10 parts per million to 200 parts per million, followed by a charge generating material overcoated on the transport layer, this material being comprised of inorganic photoconductive substances, and as an optional layer a layer of insulating organic resin overlaying the charge generating layer. The transport and generating layers can also be comprised of one composite layer. This device, with the overcoating layer, is useful in systems employing a double charging sequence, that is, charging the photoresponsive device with a uniform layer of negative charges, followed by charging with a uniform layer of positive charges.

3 Claims, 4 Drawing Figures

METHOD OF IMAGING OVERCOATED PHOTORECEPTOR CONTAINING GOLD INJECTING LAYER

This is a division of application Ser. No. 127,174, filed Mar. 5, 1980, now U.S. Pat. No. 4,297,424.

BACKGROUND OF THE INVENTION

This invention is generally directed to an overcoated photoreceptor device, and more specifically, a gold hole injecting electrode, for use in a layered photoreceptor device, and a method of imaging utilizing such device.

The formation and development of images on the imaging surfaces of photoconductive materials by electrostatic means is well known, one of the most widely used processes being xerography, as described for example in U.S. Pat. No. 2,297,691. Numerous types of photoreceptors can be employed in such systems including organic, as well as inorganic photoreceptor materials and mixtures thereof.

There are known photoreceptors wherein the charge carrier generation and charge carrier transport functions are accomplished by discrete contiguous layers. Further known are photoreceptors which include an overcoated layer of an electrically insulating polymeric material, and in conjunction with this overcoated type photoreceptor there has been proposed a number of imaging methods. However, the art of xerography continues to advance and more stringent demands need to be met by the copying apparatus in order to increase performance standards, to obtain high quality images, and to act as protection for the photoreceptor.

In one known process using overcoated photoreceptor devices there is employed a non-ambipolar photoconductor, wherein charge carriers are injected from the substrate electrode into the photoconductor surface. In such a system in order to obtain high quality images, the injecting electrode must satisfy the requirements that it injects carriers efficiently and uniformly into the photoreceptor. A method for utilizing organic overcoated photoreceptor devices has been recently discovered, and is described in copending application, U.S. Ser. No. 881,262, filed Feb. 24, 1978, now abandoned on Electrophotographic Imaging Method, Simpei Tutihasi, inventor. In the method described in this application there is utilized an imaging member comprising a substrate, a layer of charge carrier injecting electrode, a layer of charge carrier transport material, a layer of a photoconductive charge generating material, and an electrically insulating overcoating layer. In one embodiment of operation the member is charged a first time with electrostatic charges of a first polarity, charged a second time with electrostatic charges of a polarity opposite to the first polarity in order to substantially neutralize the charges residing on the electrically insulting surface of the member, followed by exposing to an imagewise pattern of activating electromagnetic radiation, whereby an electrostatic latent image is formed. The electrostatic latent image may then be developed to form a visible image which can be transferred to a receiving member. Subsequently the imaging member may be reused to form additional reproductions after the erasure and cleaning steps have been accomplished. The actual operation of this member is best illustrated by referring to the figures which are part of the present application, namely 2A to 2C.

There continues however to be a need for overcoated photoreceptors particularly inorganic overcoated photoreceptors, which have an efficient injecting electrode that not only injects holes into a transport layer on its surface at a controlled rate over a long period of time, but which electrode can also be easily fabricated.

SUMMARY OF THE INVENTION

It is therefore an object of this invention to provide an inorganic photoresponsive device and an imaging method for utilizing this device which overcomes the above-noted disadvantages.

It is another object of this invention to provide an improved inorganic overcoated photoreceptor device, and more specifically a gold hole injecting electrode for use in such a device.

A further specific object of the present invention is to provide a gold hole injecting electrode at the interface between the supporting substrate and the transport layer which injecting electrode is easy to prepare and has excellent hole injection efficiency.

These and other objects of the present invention are accomplished by providing a layered inorganic photosensitive device, which can be used in various imaging systems, such as electrophotographic systems, this device being comprised of a substrate, or supporting base, containing on its surface a layer of hole injecting material comprised of gold, a hole transport layer in operative contact with the hole injecting layer, the transport layer being comprised of a halogen doped selenium arsenic alloy, wherein the percentage by weight of selenium present is from about 99.5 percent to about 99.9 percent, the percentage of arsenic present is from about 0.1 percent to 0.5 percent; a charge generating material overcoated on the transport layer, this material being comprised of inorganic photoconductive substances, and as a protective layer, a layer of insulating organic resin overlaying the charge generating layer. About 10 parts per million to about 200 parts per million of halogen material is present, in the transport layer. The transport and generating layers can be separate layers, with the generating layer being overcoated on the transport layer, or one composite transport generating layer can be employed.

In one preferred embodiment of the present invention this substrate is a conductive material, such as aluminum, the hole injecting layer is gold, the hole transport layer is a halogen doped selenium arsenic alloy, wherein the amount of selenium present by weight is 99.9 percent, the amount of arsenic present by weight is 0.1 percent, and the halogen material preferably chlorine, is present in an amount of from about 50 parts per million, to 100 parts per million, the charge generating layer is an alloy of a selenium, tellurium, arsenic alloy, and the overcoating layer is a polyester, or polyurethane material. As an optional layer a hole trapping layer comprised of a selenium arsenic alloy can be coated on the generating layer.

The gold injecting electrode ranges in thickness of from about 0.02 microns to 10 microns, and preferably from about 0.05 microns to 0.1 microns.

In one method of operation the above described layered photoreceptor device is charged a first time with electrostatic charges of a negative charge polarity, subsequently charged a second time with electrostatic charges of a positive polarity for the purpose of substantially neutralizing the charges residing on the electrically insulating surface of the member, and subsequently exposing the member to an imagewise pattern of activating electromagnetic radiation thereby forming an electrostatic latent image. This image can then be developed to form a visible image which is transferred to a receiving member. The imaging member may be subsequently reused to form additional reproductions after the erase and cleaning steps have been accomplished. Also the photoreceptor device of the present invention, containing no overcoating layer, can be used to produce images in well known electrophotographic imaging systems, such as xerographic systems (xerography), as described for example in numerous patents, and literature references. (U.S. Pat. No. 2,297,691).

The device of the present invention may also contain as an optional layer, a hole trapping layer which is situated between the generating layer and the overcoating insulating layer. In some instances this layer can be of importance since if holes, that is, positive charges, are not substantially retained at the interface between the above two mentioned layers, the efficiency of the photoreceptor device can be adversely affected when such holes are allowed to freely migrate back to the generator layer. For example if some of the holes are allowed to migrate they will travel towards the electrode layer and neutralize the negative charges located between the hole injecting layer and the transport layer thus reducing the overall voltage useful for succeeding processes. This could adversely affect the imaging system, as well as lower the efficiency of the device, and render the cyclic characteristics of such device unstable in some situations. The trapping layer is the subject matter of a copending application, U.S. Ser. No. 127,177, filed Mar. 5, 1980, now U.S. Pat. No. 4,286,033, titled Trapping Layer Overcoated Inorganic Photoresponsive Device, the disclosure, and examples of such copending application being totally incorporated herein by reference. Also, the disclosure and examples of related copending application, U.S. Ser. No. 127,174, filed Mar. 3, 1980, now U.S. Pat. No. 4,297,424, on Overcoated Inorganic Layered Photoresponsive Device and Process of Preparation, is totally incorporated herein by reference, especially that disclosure relating to the preparation of the various layers of the inorganic photoresponsive device.

The thickness of the optional hole trapping layer ranges from about 0.05 microns to about 5 microns, and preferably from about 0.1 micron to about 1 micron. The minimum thickness of the hole trapping layer may be less, or more, however, it must be of sufficient thickness so as to provide for sufficient trapping of holes at the overcoating interface. The maximum thickness is determined by the amount of light absorption in the trapping layer. Ideally, it is desirable to have substantially all the light absorbed in the highly sensitive generator layer (Se-Te). Trapping layers such as selenium alloys absorb much of the light (the amount depending on thickness and the wavelength). Photogeneration of mobile carriers (holes) is less efficient in the trapping layer than in the generator layer, thus sensitivity is reduced. Accordingly, it is desirable to provide a thin trapping layer, as thin as possible, consistent with efficient trapping of the injected holes coming from the rear of the structure.

In one embodiment the gold hole injecting material can be prepared by sequential vapor deposition in a vacuum coater of gold onto a supporting substrate. The gold is treated with glow discharge to render the hole injection layer more efficient. This minimizes additional oxide formation on the etched substrate, aluminum, and renders the gold more active as a hole injecting material. The transport layer is then overcoated on the gold injecting layer, followed by coating of the generating layer, on the transport layer, and optionally an organic insulating resin layer is overcoated on the generating layer, as indicated herein. Upon final curing of the photoreceptor device generally a strong bond is formed between the hole injecting layer and the substrate, and the hole injecting layer and the transport layer. Depending on the type of photoreceptor device desired the process conditions can vary accordingly.

The substrate, which is comprised in one embodiment of a flexible high purity aluminum sheet should be treated prior to deposition of the gold. Thus, for example, a polished aluminum sheet is abraded with Scotch Brite until a matte finish is obtained, followed by etching with an Efferal solution. In another embodiment, when a rigid cylindrical aluminum drum is used as the substrate, it is first subjected to a mild caustic etch using a known mixture of trisodium phosphate, sodium carbonate and water. In addition, prior to use, a further etching with an Efferal solution can be employed.

The transport layer which is comprised of a halogen doped selenium-arsenic alloy is evaporated by current state-of-the-art techniques, in order to result in a layer of the desired thickness, as described hereinafter. The amount of alloy present in the evaporation boats will depend on the specific coater configuration and other process variables but will be calibrated to yield the desired transport layer thickness. Chamber pressure during operation is of the order of less than $4\times10^{-5}$ Torr. Evaporation is completed in 15 to 22 minutes with the molten alloy temperature ranging from 250° C. to 325° C. Other times and temperatures outside these ranges are also useable as will be understood by those skilled in the art. During deposition of the transport layer it is desirable that the substrate temperature be maintained in one range of from about 60° C. to about 80° C. (degrees centigrade).

The generating layer is prepared by grinding the selenium tellurium arsenic alloy, and preparing pellets from the grounded material so as to result in a layer of the desired thickness as indicated hereinafter. The pellets are evaporated from crucibles using a time/temperature crucible program designed to minimize the fractionation of the alloy during evaporation. In a typical crucible program this layer is formed in 12–15 minutes, during which time the crucible temperature is increased from 25° C. to 385° C.

BRIEF DESCRIPTION OF THE DRAWINGS

For a better understanding of the present invention and further features thereof reference is made to the following detailed description of various preferred embodiments wherein.

DESCRIPTION OF THE PREFERRED EMBODIMENTS

Figure 1:
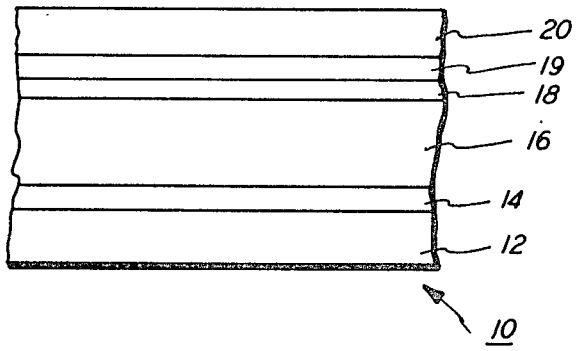
FIG. 1 is a partially schematic cross-sectional view of the layered photoreceptor device of the present invention.

Illustrated in FIG. 1 is a photoreceptor device generally designated 10 comprising a substrate layer 12, overcoated with a hole injecting layer 14 comprised of gold, which in turn is overcoated with a transport layer 16 which is comprised of a halogen doped selenium arsenic alloy as defined herein, which layer in turn is overcoated with a generating layer 18 comprised of inorganic photoconductive substances, such as alloys of selenium tellurium and as an optional layer a hole trapping layer 19, and finally an overcoating 20 of an insulating organic resin such as a polyurethane or polyester.

Substrate layer 12 may comprise any suitable material having the requisite mechanical properties, thus for example, this substrate can be comprised of a layer of an organic or inorganic material having a conductive surface layer thereon, or conductive materials such as aluminum, nickel, and the like. One of the primary purposes of the substrate layer is for support and systems can be envisioned where the substrate might be disposed with entirely. The thickness of the substrate layer, which in some instances can be an optional layer, is dependent upon many factors including economic considerations, design of the machine within which the photoresponsive device is to be used, thus this layer may be of substantial thickness for example up to 200 mils, or of minimum thickness, that is approximately 5 mils, provided there are no adverse effects on the system. Generally, however, the thickness of this layer ranges from about 5 mils to about 200 mils. The substrate can be flexible, or rigid, and may have many different configurations, such as for example, a plate, a cylindrical drum, a scroll, or an endless flexible belt, and the like.

The hole injecting layer 14, which is comprised of gold, injects charge carriers or holes into layer 16 under the influence of an electrical field in a preferred embodiment of the present invention. The injected charge carriers should be of the same polarity as the mobile carriers transported by the transport layer, layer 16, during the imaging process. The thickness of the gold layer ranges from about 0.02 microns to about 10 microns, and preferably from about 0.5 micron to about 0.1 microns. The minimum and maximum thickness of this layer is generally determined by the electrical properties desired, and it is not intended to be limited to the specific thickness disclosed. Also the charge carrier (hole) injecting layer, and the charge carrier transport layer require a particular work function relationship in order that the holes to be injected from the former into the latter can be effectively accomplished, while minimizing the injection of the opposite sign carriers.

The transport layer 16 is comprised of a halogen doped selenium arsenic alloy wherein the percent of selenium present ranges from about 99.5 percent to about 99.9 percent, and the percentage of arsenic present ranges from about 0.1 percent to about 0.5 percent. The amount of halogen, chlorine, fluorine, iodine, or bromine present ranges from about 10 parts per million to about 200 parts per million, with the preferred range being from 50 parts per million, to 100 parts per million. The preferred halogen is chlorine. This layer generally ranges in thickness of from about 20 to about 60 microns, and preferably from about 25 microns to about 50 microns. Other inorganic photoconductive materials that can be used for this layer including for example amorphous selenium, various other selenium alloys including selenium tellurium, arsenic sulfur selenium, selenium doped with various halogen materials, and other suitable panchromatic inorganic photogenerating substances.

The inorganic photoconductive generating layer 18 which in a preferred embodiment is comprised of a selenium tellurium arsenic alloy, with the percentage of selenium being from about 70 percent to about 90 percent, the percentage of tellurium being from about 10 percent to about 30 percent, and the percentage of arsenic being from about 2 percent to about 10 percent; subject to the provision that the total percentage of the three ingredients totals 100 percent, and preferably about 75 percent of selenium, 21 percent of tellurium, and 4 percent arsenic. This layer ranges in thickness of from about 0.1 micron to about 5 microns, and preferably from 0.2 to about 1 micron. The generating layer generally is of a thickness which is sufficient to absorb at least 90% or more of the incident radiation which is directed upon it in the imagewise exposure step.

The optional hole trapping layer 19 is comprised of inorganic materials, such as selenium, selenium alloys including arsenic selenium, arsenic sulfur selenium, selenium doped with various halogen materials and the like, or organic materials such as nitrogen containing compounds like aromatic amines, this layer ranging in thickness of from about 0.05 microns to about 5 microns. Preferably this layer has a thickness of about 0.1 micron, to about 1 micron.

The electrically insulating overcoating layer 20 is generally from about 5 to about 25 microns in thickness, and preferably from about 12 to about 18 microns in thickness. Generally this layer provides a protective function, in that the photoconductive material surface is kept from being contacted by toner and ozone which is generated during the imaging cycles, and from physical damage from scratching and the like. The overcoating layer also prevents corona chargers from penetrating through it into the charge generating layer 18 or from being injected into it by the latter. Preferably therefore, layer 20 comprises materials having high resistance to charge carrier injection and low carrier mobilities. The minimum thickness of this layer is determined by the function the layer must provide, whereas the maximum thickness is determined by mechanical considerations and the resolution capability desired for the photoresponsive device. Typical suitable overcoating materials include polyethylenes, polycarbonates, polystyrenes, polyesters, polyurethanes, and the like, with polyurethanes commercially available from Mobil Corporation or Kansai Paint Company, and polyesters commercially available from Goodyear Chemical Company being the preferred overcoating layer.

The formation of the insulating layer over the charge generating layer may be accomplished by any one of several methods known in the art such as spraying, dipping, roll coating and the like, by which a solution of one layer material is applied. By evaporation of the solvent, a hard resistive layer is left. Non-solution methods may also be used.

Figure 2A:
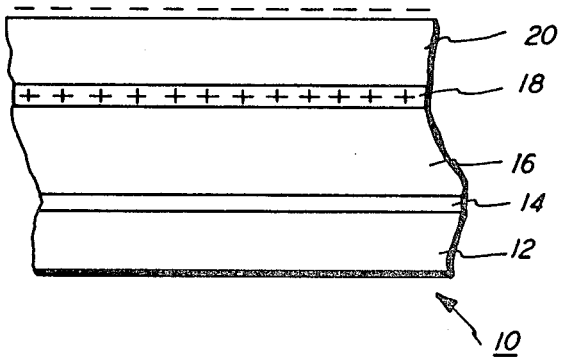
FIGS. 2A to 2C illustrate the imaging steps employed.
Figure 2B:
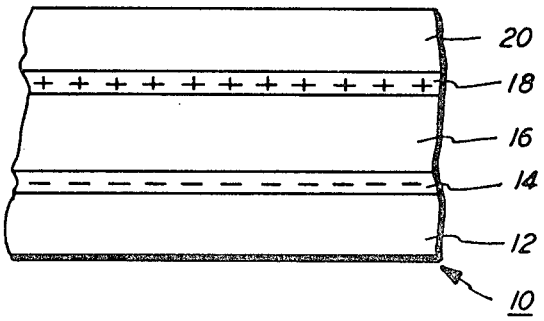
Figure 2C:
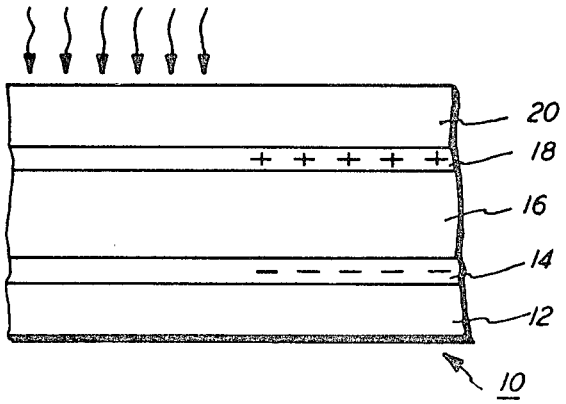

The operation of the member of the present invention is illustrated in FIGS. 2A–2C. In this illustrative explanation the initial charging step is carried out with negative polarity. As noted previously, the method is not limited to this embodiment. Moreover, the description of the method will be given in conjunction with a proposed theoretical mechanism, by which the method is thought to be operative, in order to better aid those skilled in the art to understand and practice the invention. It should be noted, however, that the method has been proved to be operable and highly effective through actual experimentation and any inaccuracy in the proposed theoretical mechanism of operation is not to be construed as being limiting of the invention.

Referring to FIG. 2A, there is seen the condition of the photoreceptor after it has been electrically charged negatively a first time, uniformly across its surface in the absence of illumination, by any suitable electrostatic charging apparatus such as a corotron. The negative charges reside on the surface of electrically insulating layer 20. As a consequence of the charging an electrical field is established across the photoreceptor, and as a consequence of the electrical field and the work function relationship between layers 14 and 16, holes are injected from the charge carrier injecting layer into the charge carrier transport layer. The holes injected into the charge carrier transport layer are transported through the layer, enter into the charge carrier generating layer 18 and travel through the latter until they reach the interface between the charge carrier generating layer 18 and the electrically insulating layer 20, where they become trapped, by trapping layer 19. The charges thus trapped at the interface establish an electrical field across the electrically insulating layer 20. Thus, it is seen that in the embodiment where negative charging is carried out in the first charging step, charge carrier injecting layer 14 and charge carrier transport layer 16 must comprise materials which will allow injection of holes from the former into the latter. Also, the charge carrier transport layer 16 and the charge carrier generating layer 18 allow injection of holes from the former into the latter, and allow the holes to reach the interface between layer 18 and electrically insulating layer 20.

Subsequently, the member is charged a second time, again in the absence of illumination, with a polarity opposite to that used in the first charging step in order to substantially neutralize the charges residing on the surface of the member. In this illustrative instance, the second charging of the member is with positive polarity. After the second charging step the surface of the photoreceptor should be substantially free of electrical charges. The substantially neutralized surface is created by selecting a charging voltage, such that the same number of positive charges are deposited as negative charges previously deposited. By "substantially neutralized" within the context of this invention is meant that the voltage across the photoreceptor member, upon illumination of the photoreceptor, is substantially zero.

FIG. 2B illustrates the condition of the photoreceptor after the second charging step. In this illustration no charges are shown on the surface of the member. The positive charges residing at the interface of layers 18 and 20 as a result of the first charging step remain trapped at the interface, at the end of the second charging step. However, there is now a uniform layer of negative charges located at the interface between layers 14 and 16.

Therefore the net result of the second charging step is to establish a uniform electrical field across the charge carrier transport and charge carrier generating layers. To achieve this result it is critical that the negative charges be located at the interface between charge carrier injecting layer 14 and charge carrier transport layer 16, and be prevented from entering into and being transported through the transport layer. For this reason it is mandatory to utilize a charge carrier transport material which will allow injection of only one species of charge carrier holes in this illustrative instance. This is especially necessary when a charge carrier transport material is used which is capable of transporting both species of charge carriers.

Subsequently, reference FIG. 2C, the member is exposed to an imagewise pattern of electromagnetic radiation to which the charge carrier generating material comprising layer 18 is responsive. The exposure of the member may be effected through the electrically insulating overcoating. As a result of the imagewise exposure an electrostatic latent image is formed in the photoreceptor. This is because hole electron pairs are generated in the light-struck areas of the charge carrier generating layer. The light-generated holes are injected into the charge carrier transport layer and travel through it to be neutralized by the negative charges located at the interface between the layers 14 and 16. The light-generated electrons neutralize the positive charges trapped at the interface between layers 18 and 20. In the areas of the member which did not receive any illumination, the positive charges remain in their original position. Thus, there continues to be an electrical field across the charge carrier transport and charge carrier generating layers in areas which do not receive any illumination, whereas the electrical field across the same layers in the areas which receive illumination is discharged to some low level (FIG. 2C).

The electrostatic latent image formed in the member may be developed to form a visible image by any of the well-known xerographic development techniques, for example, cascade, magnetic brush, liquid development and the like. The visible image is typically transferred to a receiver member by any conventional transfer technique and affixed thereto. While it is preferable to develop the electrostatic latent image with marking material the image may be used in a host of other ways such as, for example, "reading" the latent image with an electrostatic scanning system.

When the photoreceptor device of the present invention is to be reused to make additional reproductions, as is the case in a recyclable xerographic apparatus, any residual charge remaining on the photoreceptor after the visible image has been transferred to a receiver member typically is removed therefrom prior to each repetition of the cycle as is any residual toner material remaining after the transfer step. Generally, the residual charge can be removed from the photoreceptor by ionizing the air above the electrically insulating overcoating of the photoreceptor, while the photoconductive carrier generating layer is uniformly illuminated and grounded. For example, charge removal can be effected by A.C. corona discharge in the presence of illumination from a light source, or preferably a grounded conductive brush could be brought into contact with the surface of the photoreceptor in the presence of such illumination. This latter mode also will remove any residual toner particles remaining on the surface of the photoreceptor.

The invention will now be described in detail with respect to specific preferred embodiments thereof, it being understood that these examples are intended to be illustrative only and the invention is not intended to be limited to the materials, conditions, process parameters and the like recited herein. All parts and percentages are by weight unless otherwise indicated.

EXAMPLE I

Gold wire of 0.020 inch diameter as obtained from Engelhard Industries, Carteret, N.J., is cut into lengths of $\frac{1}{2}$ inch to 1 inch and evaporated from a molybdenum crucible onto an aluminum substrate, 150 mils in thickness, at room temperature and a pressure of $10^{-4}$ milimeters (mm) of mercury ($H_g$). The resultant gold film of about 0.1 microns thickness is then treated with a glow discharge plasma at a pressure of 50 microns of mercury and simultaneously heated to 45° C. A film 60 microns in thickness of a halogen doped selenium arsenic alloy (99.6 selenium, 0.33 percent arsenic, 20 ppm chlorine, which layer functions both as the transport layer, and as the generating layer), is then evaporated onto the gold at 60° C. and $10^{-4}$ mmHg.

There results from the above method a layered inorganic photoresponsive device comprised of an aluminum substrate, overcoated with a gold injecting layer, which in turn is overcoated with a charge transport, charge generating composite layer of a halogen doped arsenic selenium.

EXAMPLE II

A layered inorganic photoresponsive device was prepared in accordance with Example I, with the exception that there was coated on the halogen doped selenium arsenic alloy layer, as a separate layer, a generating layer, 0.3 microns in thickness, comprised of an alloy of selenium, 75 weight percent, tellurium, 21 weight percent, and arsenic, 4 weight percent; resulting in a layered photoresponsive device.

EXAMPLE III

The procedure of Example II is repeated with the exception that there was coated on the generating layer, a hole trapping layer, 0.1 microns in thickness, comprised of a selenium-arsenic alloy, containing 98 percent selenium and 2 percent arsenic.

EXAMPLE IV

The photoresponsive devices as prepared in Example I, and II were overcoated at room temperature, with an organic polyurethane overcoating, 12 microns in thickness by use of a spray gun.

This overcoated photoreceptor devices when used in an imaging system employing double charging, that is, charging with uniform negative charges, followed by charging with an equal number of positive charges, resulted in images of high quality, and excellent resolution.

EXAMPLE V

The photoresponsive devices as prepared in Example I, and II, were compared with photoresponsive devices with injection layers of other materials with the following results:

| MATERIAL | HOLE INJECTION EFFICIENCY |
|---|---|
| Gold | 100% |
| Copper | 14% |
| Cadmium | 10% |
| Zinc | 13% |

-continued

| MATERIAL | HOLE INJECTION EFFICIENCY |
|---|---|
| Chromium | 12% |

Although this invention has been decribed with respect to certain preferred embodiments, it is not intended to be limited thereto, rather those skilled in the art will recognize that variations and modifications may be made therein which are within the spirit of the invention and scope of the claims.

What is claimed is:

1. An electrophotographic imaging method which comprises subjecting a photoresponsive device consisting of (a) a substrate;

(b) a layer of hole injecting material capable of injecting holes into a layer on its surface, this layer being comprised of gold, and having a thickness of from about 0.02 microns to about 10 microns;

(c) a hole transport layer in operative contact with the hole injecting layer, this layer being comprised of a halogen doped selenium-arsenic alloy wherein the percentage of selenium present by weight is from about 99.5 percent to about 99.9 percent, the percentage of arsenic present by weight is from about 0.5 percent to about 0.1 percent, and the halogen is present in an amount of from about 10 parts per million, to about 200 parts per million;

(d) a charge generating layer overcoated on the hole transport layer, consisting of an inorganic photoconductive material, the charge generating layer having a thickness of from about 0.1 micron to about 5 microns;

(e) an electrically insulating organic resin overlaying the charge generating layer; and (f) a hole trapping layer situated between the generating layer and the overcoating layer, said trapping layer having a thickness of from about 0.05 microns to about 5 microns and being comprised of inorganic materials selected from selenium, selenium alloys, and halogen doped selenium arsenic alloys, to charging with negative electrostatic charges, followed by charging with positive electrostatic charges, in order to substantially neutralize the negative charges residing on the surface of the device, followed by exposing the device to an imagewise pattern of electromagnetic radiation to which the charge carrier generating material is responsive, whereby there is formed an electrostatic latent image on the device, developing said latent image with a toner and optionally transferring said toner to a permanent substrate subsequent to development.

2. An electrophotographic imaging method in accordance with claim 1 wherein the substrate is conductive and the halogen is chlorine.

3. An electrophotographic imaging method in accordance with claim 2 wherein the substrate is aluminum.

* * * * *